United States Patent [19]

Princiotta et al.

[11] 4,365,735

[45] Dec. 28, 1982

[54] FORMING A POCKET WELT

[76] Inventors: Raymond A. Princiotta, 208 N. Concord Ave., Havertown, Pa. 19083; Antonio Salvucci, 131 Windswept Dr., Feasterville, Pa. 19047

[21] Appl. No.: 189,050

[22] Filed: Sep. 22, 1980

[51] Int. Cl.[3] ..... A41H 33/00

[52] U.S. Cl. ..... 228/38; 2/247

[58] Field of Search ..... 223/37, 38, 3, 51, 52, 223/52.6, 57; 2/247; 112/120

[56] References Cited

U.S. PATENT DOCUMENTS

| | | | |
|---|---|---|---|
| 2,317,817 | 4/1943 | Silverman | 223/38 |
| 2,929,537 | 3/1960 | Price et al. | 223/38 |
| 3,730,404 | 5/1973 | Schramayr | 223/38 |
| 4,156,293 | 5/1979 | Off | 2/247 |

FOREIGN PATENT DOCUMENTS

| | | | |
|---|---|---|---|
| 1208724 | 1/1966 | Fed. Rep. of Germany | 223/38 |
| 613752 | 7/1978 | U.S.S.R. | 223/38 |

*Primary Examiner*—Louis Rimrodt

*Attorney, Agent, or Firm*—Robert S. Lipton

[57] ABSTRACT

An apparatus for forming pocket welts is disclosed. The upper portion of the external breast pocket of men and women's sport and suit jackets are frequently constructed by making a cut in the breast of the jacket and connecting a pocket to the inward side of the jacket fabric. A pocket welt is joined to the exterior of the breast, just below the cut and along its sides to form a top portion of the completed pocket. The pocket welt is constructed using a precut piece of fabric which is positioned by an operator on a template, which forms a portion of the apparatus. The fabric is secured by a vacuum and is folded by the operator along lines determined by the template. Subsequent to folding, a precut fusing material may be positioned by the operator over the fabric. The apparatus is then actuated by the operator causing the fabric and fusing to be folded and pressed, automatically. If fusing is used, the temperature of the platens may be set sufficiently high so as to cause the fusing to bond to the fabric.

11 Claims, 9 Drawing Figures

FORMING A POCKET WELT

BACKGROUND OF THE INVENTION

1. Field of the Invention

This invention relates generally to apparatus used in manufacturing articles from fabric, such as clothing and the like. In particular, the invention relates to an apparatus used in manufacturing pocket welts. Pocket welts are generally used in the manufacture of exterior breast pockets located on men and women's suit, sport jackets and vests. Such pockets are generally constructed by making a cut in the breast of the jacket and connecting a pocket to the inward side of the jacket fabric. A pocket welt is joined to the exterior of the breast, just below the cut and along its sides to form a top portion of the completed pocket.

2. Description of the Prior Art

Prior art methods of manufacturing pocket welts are almost entirely manual. The current preferred method requires operators to manually fold substantially rectangular pieces of fabric along the longitudinal axis thereof. Subsequent to folding the operator, using a sewing machine, stitches the ends thereof along a line substantially perpendicular to the fold line. The resultant piece is then turned inside out and pressed. The resultant product is the pocket welt.

Other materials or fabrics are commonly used in combination with the exterior fabric in order to provide "body" and stiffness to the pocket welt. Various materials have been used for this purpose.

Great care must be exercised when manufacturing pocket welts for two primary reasons. If the pocket is to have its upper edge at an angle the "substantially perpendicular" folds, previously referred to, in manufacturing the welt must be altered accordingly. The ability of the operator to accomplish this depends upon his or her experience and skill. An additional problem is presented when the fabric has a design thereon, which must be matched or mated with the design appearing on the remaining portion of the jacket. This presents a particularly difficult problem to the operator when such a design is presented in combination with a pocket which is to be inclined. Of course, the ability of the operator to handle this also depends upon the operator's skill and experience.

As might be expected, the error rate in manufacturing such pocket welts is relatively high. The rate becomes higher with the inexperience of the operator. Of course, the failure rate may be substantially decreased, although it is still high, through the use of experienced and skilled operators. However, experienced and skilled operators result in a higher rate of compensation and, accordingly, increase the resultant retail price of the garment.

Accordingly, it is the primary object of the present invention to provide a method and apparatus for automating the manufacture of pocket welts.

It is an object of the present invention to provide an apparatus which will assist an operator in automatically forming a pocket welt using precut pieces of fabric.

It is an object of the present invention to provide an apparatus which will provide guides for folding opposite ends of a piece of precut fabric thereby forming the ends of a pocket welt.

It is another object of the present invention to provide an apparatus for assisting an operator in folding a piece of fabric along a longitudinal axis thereby forming the top edge of a pocket welt.

It is another object of the present invention to provide an apparatus which will enable an operator to press a pocket welt.

It is still another object of the present invention to provide an apparatus and method which will secure a piece of fabric along its fold lines subsequent to its folding into a pocket welt.

It is a further object of the present invention to provide an apparatus which will secure a piece of precut fabric while it is being folded into a pocket welt.

SUMMARY OF THE INVENTION

In accordance with the invention, an apparatus is provided which will assist an operator in automatically manufacturing pocket welts. The operator and apparatus are provided with precut pieces of fabric which are to be formed into pocket welts. The precise shape of each piece of fabric will vary in accordance with the pocket of each particular garment which is being manufactured. The invention includes means for securing a piece of precut fabric within a template. As with the precut fabric, each template is uniquely designed for the pocket of a particular garment. While the piece of precut fabric is being secured within the template by a vacuum means, the operator folds the piece of precut fabric along the lateral boundaries of the template. Subsequent to folding, the vacuum action maintains the fold line along the lateral boundaries and within the confines of the template. In an alternate embodiment of the invention, such lateral folding is automatically accomplished.

At this point in the preferred embodiment of the invention, a piece of precut stiffening material, preferably fusing material, is placed over the partially folded piece of fabric. Fusing is fabric or material which has a heat sensitive coating on one or both sides thereof and which upon heating above a predetermined temperature will melt thereby acting as an adhesive. Fusing with the coating on both sides provides greater stiffness than single side coating. After the fusing has been properly positioned, a blade is activated which forces the combination of fabric and fusing through a longitudinal slot thereby folding the combination about the edge of the blade. After the blade has forced the fabric-fusing combination through the slot, platens compress the fabric-fusing combination after the blade has withdrawn, thereby pressing the fabric and fusing along the fold lines. This also causes the fusing to melt, thereby securing the fusing to the fabric. If appropriately placed, the fusing will also secure the fabric along the fold line. The resultant product is the pocket welt.

BRIEF DESCRIPTION OF THE DRAWINGS

Other objects and advantages of the invention will become apparent upon reading the following detailed description and upon reference to the drawings in which like numerals refer to like parts and in which.

While the invention will be described in connection with a preferred embodiment, it will be understood that it is not intended to limit the invention to that particular embodiment. On the contrary, it is intended to cover all variations, modifications and equivalents as may be included within the spirit and scope of the invention as defined by the appended claims.

DESCRIPTION OF THE PREFERRED EMBODIMENT

Figure 1:
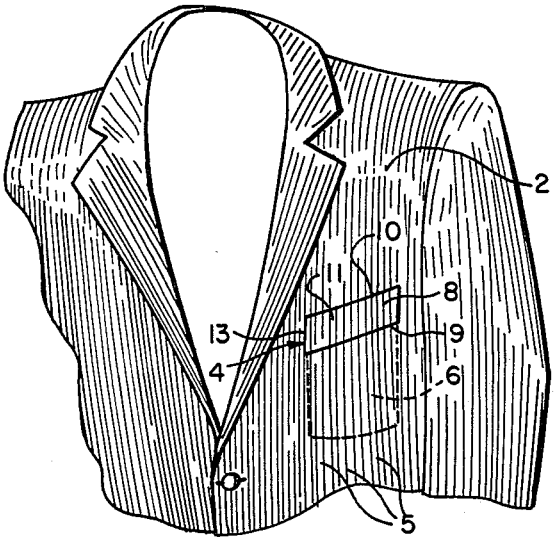
FIG. 1 is an elevation view of a jacket having a pocket therein.

Referring now to FIG. 1 there is shown a jacket 2 having a pocket 4 located on the jacket breast. The jacket 2 and and exposed portion of pocket 4 have stripes 5 thereon. The pocket 4 includes a pocket body 6 inside the jacket and a welt 8 outside the jacket which are joined together along seam 9. Of course, the sides of the welt 8 are joined to the jacket along it side edges 13. Although not shown, a cut or slit is made in the outer fabric of the jacket 2. Seam 9 joins the jacket at the lower portion of the cut, the welt 8, and the forward portion of the pocket body 6. The rear portin of the pocket body 6 is joined to the jacket at the upper portion of the cut. Thus, as is well known to those experienced in the art, a conventional and well known jacket pocket is constructed.

The pocket 4 is inclined at the top thereof, as shown for purposes of styling. Of course, when this is done the stripes 5 of the pocket 4 and the jacket 2 must still be properly aligned in order for the pocket welt 8 to match the jacket. The pocket is inclined with respect to the jacket at the top edge 10 of the welt 8. As will hereafter be described, the upper edge 10 of the welt 8 is also a fold line 10 of the fabric from which the pocket welt 8 is constructed, as is better shown in FIG. 2.

Figure 2:
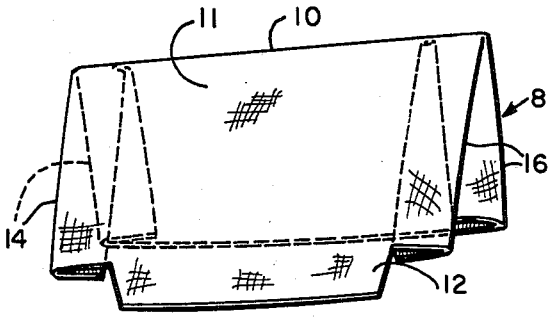
FIG. 2 is an exploded perspective view of the pocket welt shown in FIG. 1, made in accordance with the present invention.

The pocket welt 8 is shown in FIG. 2 disconnected from the jacket 2 and the pocket body 6. The outer exposed surface 11 is also shown in FIG. 1 so that the view may be properly oriented. As may be seen, the welt 8 is constructed from a single piece of fabric 12 which has been folded along fold line 10. As is also shown in FIG. 2, the fabric 12 has been folded inwardly from its two opposite ends along fold lines 14 and 16 which become the edges 13 of the welt 8. Of course, the fabric is folded inward toward the back surface of the fabric. In the preferred embodiment of the invention the fabric 12 is used in combination with a second material, preferably fusing, for adding "body" or stiffness to the combination. If it is used, the fabric 12 may be secured by the fusing subsequent to being folded along fold lines 14 and 16. The fusing is omitted from FIG. 2 for purposes of clarity.

Figure 3:
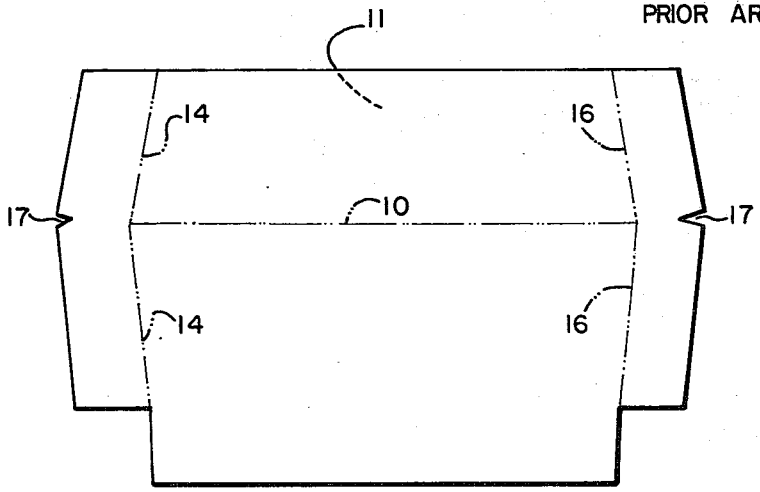
FIG. 3 is a piece of precut fabric which will become, when folded as described, the pocket welt shown in FIGS. 1 and 2.

The fabric 12 from which the welt 8 is constructed is shown in FIG. 3 completely unfolded. The fabric 12 has notches 17 which aid in folding and act as guides. As can be seen, the portion of fabric 12 which becomes the exterior surface or face 11 of the welt 8 is the back portion of the upper surface of the fabric 12, as shown in FIG. 2. In forming the welt 8 the fabric is first folded along fold lines 14 and 16 and then subsequently along fold line 10. The fabric 12 is shown in a particular precut shape or manner. The particular shape of the precut fabric 12 is a direct function of the pattern appearing on the jacket and pocket and, more importantly, the angle that the top portion 10 of the welt 8 will have to the jacket 2. Accordingly, the particular shape may vary widely.

Figure 2A:
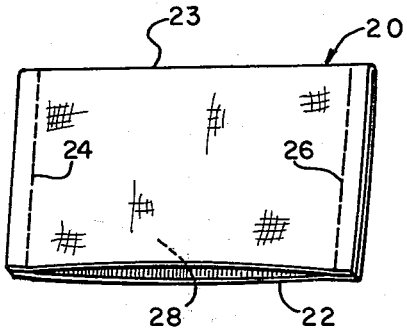
FIG. 2A PRIOR ART
FIG. 2*a* is an exploded perspective view of a prior art pocket welt which is depicted "inside out" during a particular stage of its manufacture.

A prior art pocket welt is shown in FIG. 2*a*. The prior art pocket welt 20 is generally constructed from a rectangular piece of fabric 22. The fabric 22 is first folded along the fold line 23 so that the outer surface of the fabric 28 is facing inwardly. The fabric is then stitched along lines 24 and 26. These seams 24 and 26 are analogous to fold lines 14 and 16 of the present invention in that they will become the sides of the pocket welt. Subsequent to the stitching of seams 24 and 26, the fabric is turned inside out to form the pocket welt 20. This results in the outer surface 28 of the fabric 22 to face outward.

As previously indicated, this prior art method of forming a pocket welt has the disadvantage of being very dependent upon the skill of the operator forming the welt. The skill level required increases when the pocket is positioned at an angle to the jacket, and when alignment of a design on the fabric from which the jacket and pocket is constructed is required. All of this requires the operator's skill in determining where and how to position fold 23 and seams 24 and 26.

Figure 4:
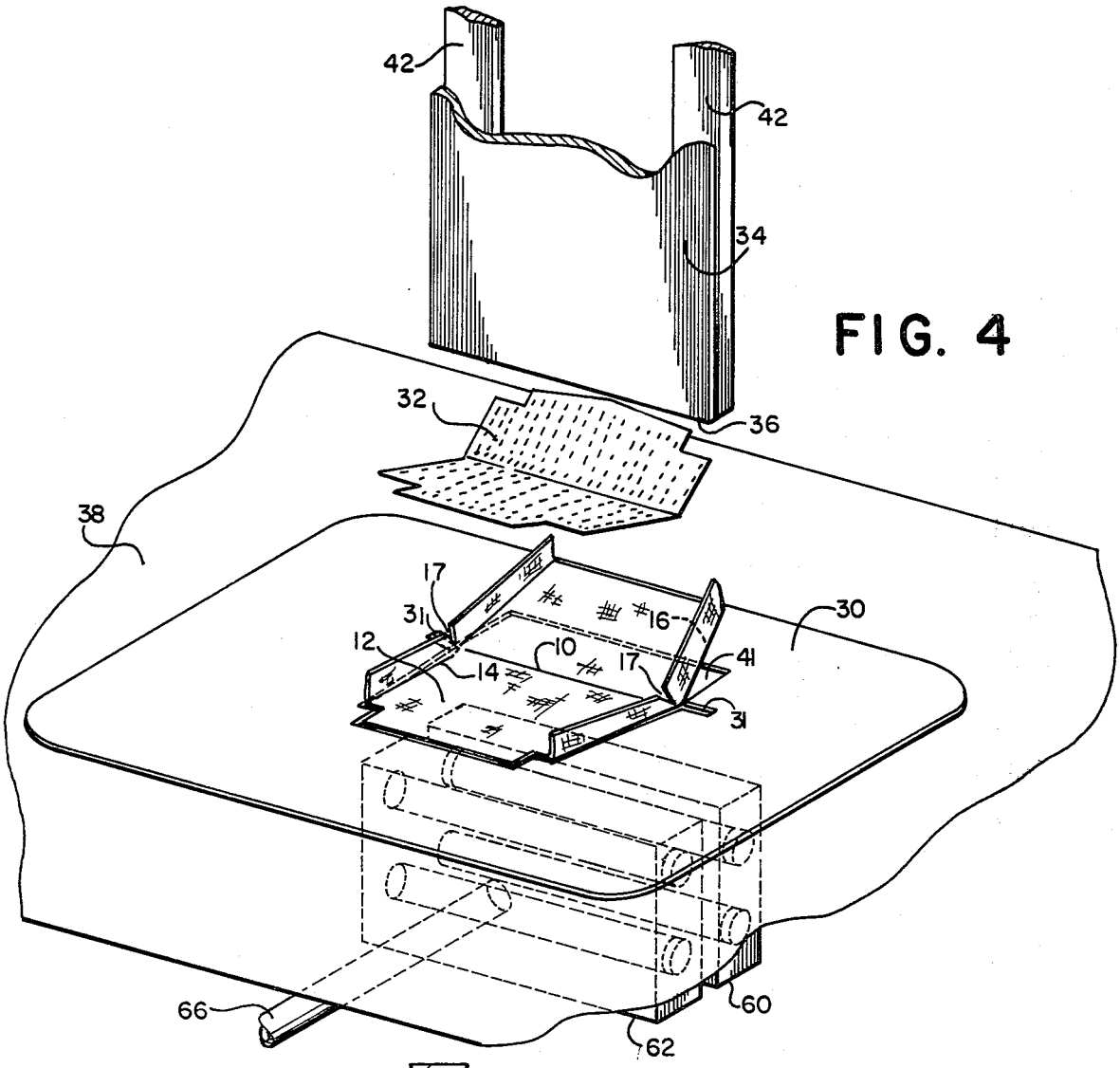
FIG. 4 is an exploded perspective view showing the manufacture of a pocket welt.

The method of the present invention will now be described, making reference to FIG. 4. A piece of precut fabric 12 is placed on a template 30. The template 30 has been preformed to match the precut fabric. As with the fabric 12, the template 30 is uniquely designed for a particular pocket welt. The template 30 has slots 31, or other means, which act as guides. When placing the fabric in a precut hole 41 in the template 30 the notches 17 in the fabric 12 are aligned with the template slots 31 to properly position the fabric.

The fabric 12 is then temporarily secured to the template 30. A vacuum is used in the preferred embodiment for temporarily securing the fabric to the template. The means for providing the vacuum will subsequently be discussed. The operator then folds the fabric 12 along the sides of the templates, thereby folding the fabric along fold lines 14 and 16. The folded fabric is also secured in position by the vacuum.

Then, if desired, a stiffer or fusing material 32 may be positioned over the folded fabric 12 which is also secured by the vacuum. The fusing material is used to provide body and stiffness to the welt, and also to secure the fabric along fold lines 14 and 16. Subsequent to the proper positioning of the fusing 32, the combination of the fusing 32 and fabric 12 is folded along fold line 10. This is accomplished by blade 34 forcing the partially completed pocket welt through a slot, not shown in FIG. 4, in the vacuum plate 38 upon which the template 30 is resting. The slots 31 in the template 30 also permit the blade 34 to pass through it. Of course, the fold line 10 is formed by the bottom edge 36 of the blade 34.

Subsequent to folding along fold line 10, the pocket welt 8 is pressed, thereby securing fold line 10 and melting the optional fusing 32.

Figure 5:
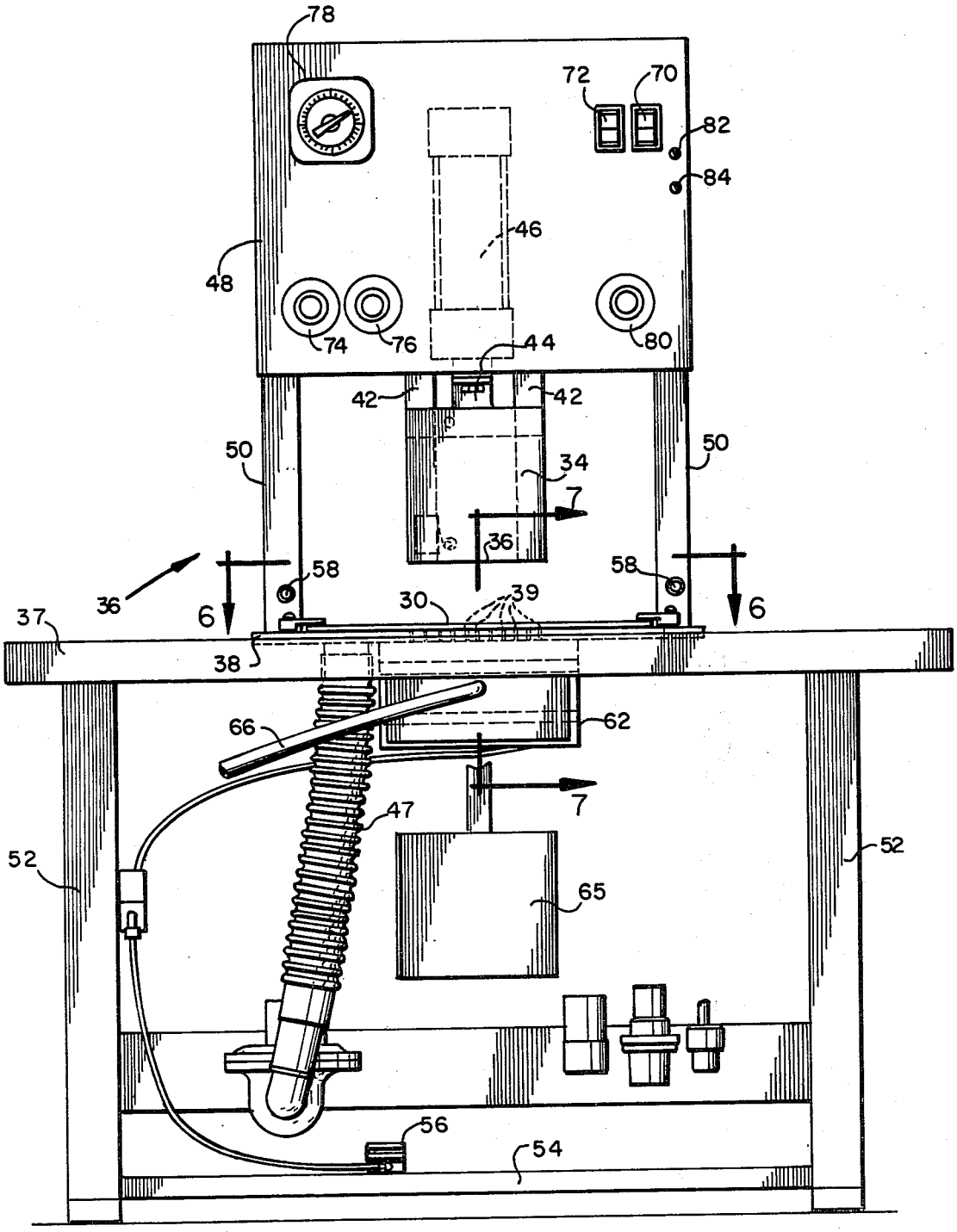
FIG. 5 is an elevation view of the apparatus of the present invention.
Figure 6:
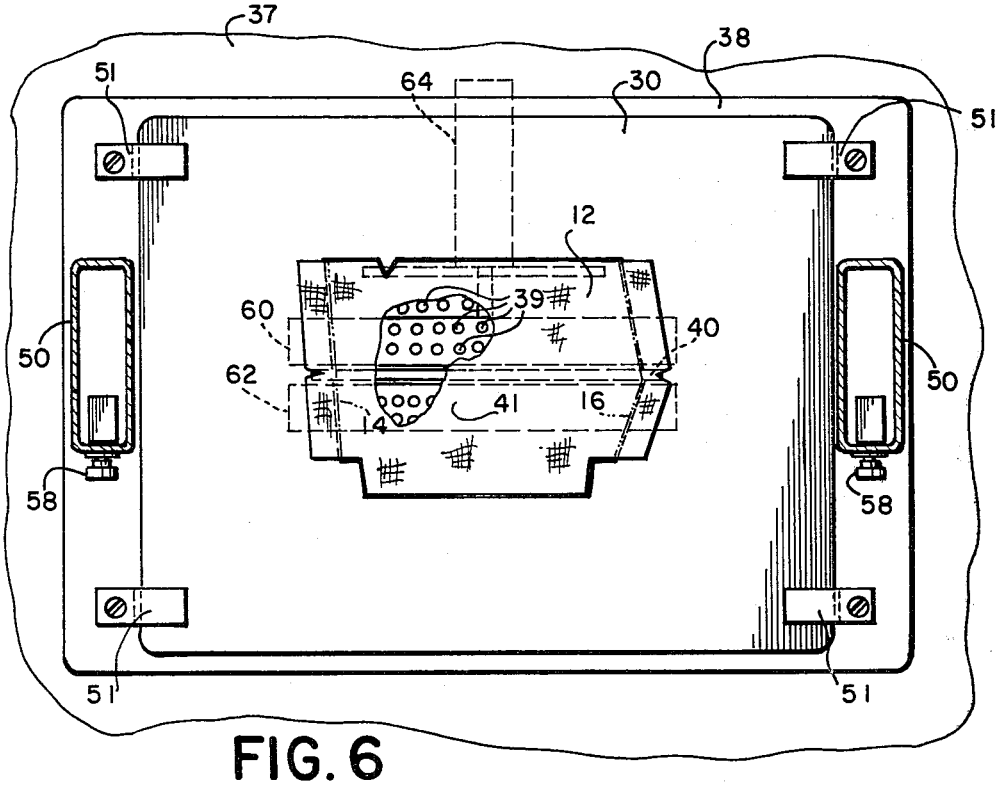
FIG. 6 is a plan view taken along line 6—6 of FIG. 5.
Figure 7:
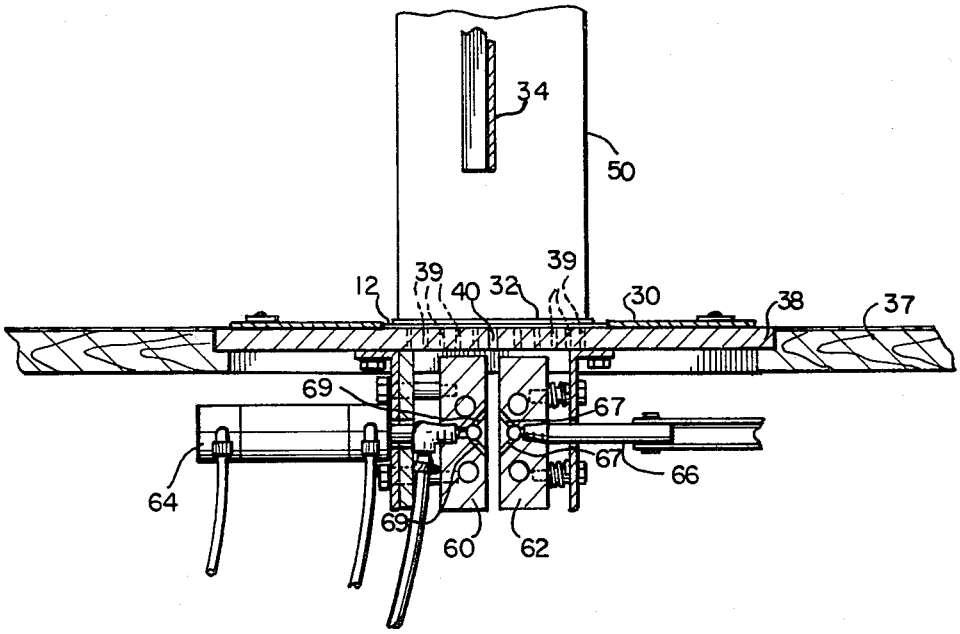
FIG. 7 is a side view taken along line 7—7 of FIG. 5 showing a portion of the apparatus of the present invention.

The apparatus for forming pocket welts is shown in FIGS. 5 through 7. Referring now to FIG. 5 where a front elevation view of the present invention is shown. The apparatus or machine 36 includes a work table 37 and a vacuum plate 38 upon which the template 30 is positioned and secured. The vacuum plate has holes 39 therein which are connected by means not shown to a hose 47 which leads to a vacuum source. As previously indicated, and as shown in FIGS. 6 and 7, there is a slot 40 in the vacuum plate 38. Positioned above the slot 40 is the blade 34 having a bottom edge 36. The blade 34 is adapted to slide along guides 42. The blade 34 is connected to an actuator rod 44 which forms a portion of a pneumatic actuator 46. It is to be understood that actuators of various types may be used in the present invention without departing from the spirit thereof. Electric motors, solenoids and hydraulic actuators could also be used as a substitute in the present invention for the pneumatic actuator of the present invention.

The pneumatic actuator 46 is connected to an upper frame 48 which is secured to the work table 37 by supports 50. The work table 37 is supported by legs 52 which are provided with a cross support member 54 at floor level.

A foot switch 56 is provided for controlling the vacuum line which secures the fabric to the template 30. Dual switches 58 are provided on the supports 50 for actuating the apparatus, including blade 34. The dual switches 58 are used for safety purposes on that the requirement that both switches 58 be activated insures the operator's hands are free and clear from the blade during its downward movement.

A top view of the work table along line 6—6 in FIG. 5 is shown in FIG. 6. The work table 37 and vacuum plate 38 having holes 39 therein is shown for providing the vacuum for securing the fabric 12. Slot 40 is also shown in the vacuum plate 38. The template 30 is shown properly positioned and secured by fasteners 51 over the holes 39 and slot 40. The fasteners 51 may be of any suitable type but should permit quick replacement of the templates. The template 30 has a large hole 41 removed from its interior, thereby exposing the holes 39 in the work table 37. As previously discussed, the hole 41 in the template will determine the shape of the welt 8. The lateral edges of the hole 41 determine the fold lines 14 and 16 of the fabric 12. The fabric 12 is shown positioned over the template 30 by aligning the fabric notches 17 with the template slots 31 prior to the folding thereof along fold lines 14 and 16. Of course, fold lines 14 and 16 are determined by the edges of the hole 41 in the template 30.

A side view taken along line 7—7 of FIG. 5 is shown in FIG. 7. The work table 37 is shown with the template 30 thereon. The blade 34 is shown suspended above the work table 37. The fabric 12 and fusing 32 are shown positioned over the template. Positioned below the vacuum plate 38 and connected to it are platens 60 and 62. The platens may alternately be connected to the table 37. When the blade 34 forces the fabric 12 and optional fusing 32 through the slot 40 and begins withdrawing, platen 60 moves towards platen 62 as a result of pneumatic actuator 64. Platen 62 is positioned on spring supports. Platens 60 and 62 press the fabric 12 and optional fusing 32 after the blade 34 has withdrawn. Subsequent to pressing, the platens disengage permitting the welt to fall onto chute 65.

In some cases it is desirable to use steam when pressing the fabric to form the pocket welt. Accordingly, the platen 62 includes channels 67 which end at the surface of the platen forming orifices for steam. The other end of the channels 67 are connected to steam line 66. The steam line is connected to a source of steam, and to a valve, not shown, positioned along its length. The valve is connected to the system so as to provide steam only when the platens are in the process of pressing the fabric.

It has been found desirable to provide suction to remove the steam so as to prevent undue condensation of the steam, thereby wetting the welt. The suction is provided by channels 69 which end in orifices on the surface of platen 60. The other ends of the orifices are connected to a suction source through tube 71.

Referring now to FIG. 5 where the controls for the apparatus or machine 36 are shown. A main power switch 70 is provided along with switch 72 for providing steam, if that option is preferred by the user. Thermostats 74 and 76 are provided for controlling the temperature of platens 60 and 62, respectively. A timer 78 is provided for controlling the time platens 60 and 62 are engaged. A control 80 is provided for adjusting the pressure or force at which the platens 60 and 62 engage together during pressing. Screw adjustments 82 and 84 are provided for adjusting the speed of the blade during its upward and downward motions, respectively.

In operation, a supply of precut fabric pieces 12 and optional fusing pieces 32 will be provided to an operator. The main power switch 70 and optional steam switch 72 will be actuated. The proper template will be inserted on the vacuum plate 38 and properly aligned with slot 40 and secured to the work table 37.

Air will be drawn through holes 39 in the vacuum plate 38 below the template 30, thereby creating the vacuum to secure the fabric 12 to the work table 37 and template 30. The vacuum is provided by depressing foot switch 56. The vacuum will cease when the switch extends upon foot removal. With the vacuum off, the operator will properly position the fabric 12 with respect to the template by aligning the fabric notches 17 with the template slot 31. A loose positioning tolerance is permitted as it is the template and its proper positioning on the work table 37 which primarily determine the resultant shape of the pocket welt 8. When the fabric 12 has been properly positioned with respect to the template 38, the operator using foot switch 56 turns on the vacuum, thereby securing the fabric. The operator then folds the fabric 12 along the lateral edges of the template 30, thereby folding the fabric along fold lines 14 and 16, as shown in FIG. 6. Once the fabric has been folded along line 14 and 16 the folded-over fabric is also secured by the vacuum. The operator may also, at this point, position fusing over the folded fabric, which is also held in place by the vacuum.

The operator then uses both hands to actuate the dual switches 58. This causes the apparatus 36 to proceed automatically through the following steps. The blade 34 is caused to move downwardly, causing its lower edge 36 to force the fabric 12 and fusing 32 to fold around edge 36 as it passes through the slot 40 in the work table 37. The vacuum to holes 39 is maintained until the fabric has passed through slot 40. This may be accomplished automatically or by removal of the operator's foot from switch 56. The platen 60 is moved toward the platen 62 when the blade 34 is withdrawing from its most downward position. The platens compress the fabric after the withdrawal of the blade. The optional steam is automatically provided, if desired. The heat from the platens presses in the fold lines 14, 16 and 10. The heat from the platens also causes the fusing to melt, thereby securing the fabric along fold lines 14 and 16. If a fusing with both sides thereof is coated with heat sensitive material, the fabric will have fold line 10 secured also. The blade, of course, rises to its uppermost position and stops. The platens disengage when the time set on timer 78 has expired. The steam is automatically terminated when the platens disengage. Upon disengagement of the platens the completed pocket welt falls into the chute 65 properly positioned for that purpose.

Figure 8:
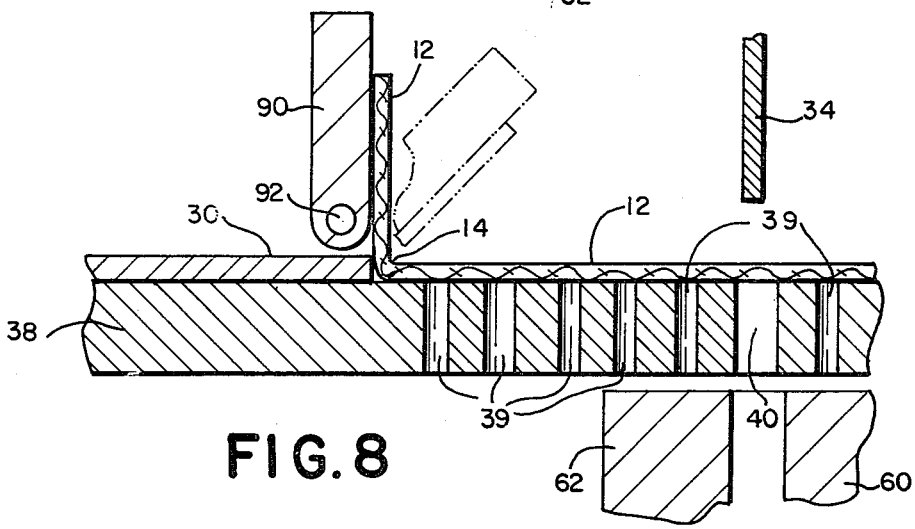
FIG. 8 is a portion of the apparatus shown in FIG. 5 incorporating an additional feature.

Referring now to FIG. 8, an alternate embodiment of the apparatus of the invention is shown. The vacuum plate 38 and template 30 are shown with fabric 12 positioned thereon. An arm 90 is shown for automatically folding the fabric along fold line 14. Of course, another arm, not shown in FIG. 8, is provided for folding the fabric along fold line 16, also not shown in FIG. 8. Arm 90 is pivotally connected to the machine by conventional means, not shown, so that arm 90 will pivot about point 92 so as to fold fabric 12, as is shown in phantom. In operation, the operator would position the fabric 12 as heretofore described and press both switches 58 to activate the machine. Arms 90 would then automatically fold the fabric along fold lines 14 and 16 and would then proceed as heretofore described with the downward movement of the blade 34.

In describing the present invention various details, well known to machine designers skilled in the art, have been omitted for purposes of clarity. This includes the details of the pneumatic actuators, micro switches, and circuitry which enable the process and apparatus described herein to proceed and be controlled.

Thus it is apparent that there has been provided, in accordance with the invention, an apparatus and method that fully satisfies the objects, aims, and advantages set forth above. While the invention has been described in conjunction with a specific embodiment thereof, it is evident that may alternatives, modifications, and variations will be apparent to those skilled in the art in light of the foregoing description. Accordingly, it is intended to embrace all such alternatives, modifications, and variations as fall within the spirit and scope of the appended claims.

What is claimed is:

1. A method of forming a pocket welt from fabric having a finished surface and an opposite unfinished surface which comprises:

cutting the fabric into pieces having opposite sides and a top and bottom, then positioning the fabric within an opening in a template, the template being positioned on a work surface so that its finished surface is faced downwardly, the surface having a multiplicity of holes therein through which air may be drawn creating a partial vacuum, then securing the fabric to the work surface by creating a partial vacuum, then folding the sides of the fabric inwardly along predetermined lines, then folding the fabric inwardly about a predetermined line passing between the sides of the fabric by forcing the fabric through a slot in the surface by a blade which is adapted to pass through the slot, so that it is positioned between two platens located below the surface, then withdrawing the blade, the fabric being maintained between the platens due to its resilience, and then pressing the fabric to form creases in the fabric at the folds by causing the platens to move toward each other.

2. The method of claim 1 which further includes the step of said positioning a fabric piece while engaging in the step of pressing another fabric piece.

3. The method of claim 1 which includes the step of dropping the fabric into a receptacle subsequent to pressing.

4. The method of claim 1 wherein said folding the sides of the fabric is automatically performed.

5. The method of claim 1 wherein said folding about a line is automatically performed.

6. The method of claim 1 wherein both of said folding steps are automatically performed.

7. The method of claim 1 which further includes the step of placing stiffening material on the fabric after the step of folding the sides of the fabric inwardly.

8. An apparatus for forming a pocket welt from precut pieces of fabric which comprises:

a frame, a work surface connected to said frame having a multiplicity of openings therein through which air may be drawn, creating a partial vacuum, a template having a hole therein, having sides and a top and bottom, the shape of said hole being determined by the design of the particular welt being formed, said template being connected to said work surface, vacuum means connected to said work surface so as to draw air through said opening in said work surface thereby causing said fabric to be held against said work surface by a difference in air pressure, means for automatically folding the fabric about a predetermined line passing between the sides of the fabric connected to said frame including a slot in said work surface coincident with said fold line, and a blade movably connected to said frame, initially positioned above said work surface, so as to pass through said slot and below said work surface thereby causing the fabric to be folded as it is forced about said blade as said blade passes through said slot, and pressing means for pressing said fabric after said fabric has been folded, and subsequent to withdrawal of said blade, located below said work surface.

9. The apparatus of claim 8 wherein said pressing means includes a source of steam connected thereto.

10. The apparatus of claim 8 wherein said pressing means includes suction means connected thereto to remove excess steam thereby preventing water condensation on the fabric.

11. The apparatus of claim 8 wherein said openings in said work surface are a multiplicity of holes in said surface, said holes being connected to said vacuum means which includes a source of air pressure less than ambient, so that ambient air tends to pass through the fabric into said holes thereby exerting a force on the fabric retaining it to said surface.

* * * * *